US008323008B2

(12) United States Patent
Grimes et al.

(10) Patent No.: US 8,323,008 B2
(45) Date of Patent: Dec. 4, 2012

(54) PUMPS AND PUMP-HEADS COMPRISING INTERNAL PRESSURE-ABSORBING MEMBER

(75) Inventors: David J. Grimes, Jacksonville, FL (US); Keith J. Wardle, Potton (GB)

(73) Assignee: Micropump, Inc., a unit of IDEX Corporation, Vancouver, WA (US)

( * ) Notice: Subject to any disclaimer, the term of this patent is extended or adjusted under 35 U.S.C. 154(b) by 830 days.

(21) Appl. No.: 12/201,983

(22) Filed: Aug. 29, 2008

(65) Prior Publication Data

US 2009/0060728 A1 Mar. 5, 2009

Related U.S. Application Data

(60) Provisional application No. 60/967,125, filed on Aug. 30, 2007.

(51) Int. Cl.
*F04B 11/00* (2006.01)

(52) U.S. Cl. ..... 417/540; 138/26; 138/30

(58) Field of Classification Search ..... 417/540, 417/420; 139/26–28, 32; 138/26–32
See application file for complete search history.

(56) References Cited

U.S. PATENT DOCUMENTS 4,629,562 A * 12/1986 Kercher ..... 210/198.2
4,802,818 A 2/1989 Wiggins et al.
5,141,415 A * 8/1992 Budecker et al. ..... 417/540
5,516,266 A * 5/1996 Talaski ..... 417/540
5,704,767 A * 1/1998 Johnson ..... 417/43
5,860,799 A * 1/1999 Scheibe et al. ..... 417/540
7,029,250 B2 * 4/2006 Kach ..... 417/540

OTHER PUBLICATIONS

International Search Report and Written Opinion of the International Searching Authority, mailed Nov. 19, 2008, from PCT Application No. PCT/US2008/074882.

* cited by examiner

*Primary Examiner* — Devon Kramer
*Assistant Examiner* — Ryan Gatzemeyer
(74) *Attorney, Agent, or Firm* — Klarquist Sparkman, LLP

(57) ABSTRACT

An exemplary pump includes a pump housing defining a pump cavity, a movable pumping member situated in the pump cavity, and at least one pressure-absorbing member located inside the pump housing. The housing also has an inlet and an outlet, and includes at least one interior non-wearing location that contacts liquid in the pump housing when the pump housing is primed with the liquid. The movable pumping member, when driven to move, urges flow of the liquid from the inlet through the pump cavity to the outlet. The at least one pressure-absorbing member is located inside the pump housing at the non-wearing location and contacts the liquid. The pressure-absorbing member has a compliant property to exhibit a volumetric compression when subjected to a pressure increase in the liquid contacting the pressure-absorbing member, the volumetric compression being sufficient to alleviate at least a portion of the pressure increase.

21 Claims, 6 Drawing Sheets

(SECTION A-A)

(DETAIL B)

PUMPS AND PUMP-HEADS COMPRISING INTERNAL PRESSURE-ABSORBING MEMBER

CROSS-REFERENCE TO RELATED APPLICATION

This application claims priority to, and the benefit of, U.S. Provisional Patent Application No. 60/967,125, filed on Aug. 30, 2007, incorporated herein by reference in its entirety.

FIELD

This disclosure pertains to, inter alia, gear pumps and other pumps configured to operate in a substantially primed condition to urge flow of a liquid. The subject pumps and pump-heads include various types having one or more rotary members, such as meshed gears, or at least one pumping member that operates continuously in a cyclic manner. More specifically, the disclosure pertains to pumps and pump-heads capable of accommodating a volume expansion of the liquid in the pump-head such as by a freezing event, a pressure fluctuation, or the like.

BACKGROUND

Several types of pumps are especially useful for pumping liquids and other fluids with minimal back-flow and that are amenable to miniaturization. An example is a gear pump. Another example is a piston pump. A third example is a variation of a gear pump in which the rotary pumping members have lobes that interdigitate with each other. Gear pumps and related pumps have experienced substantial acceptance in the art due to their comparatively small size, quiet operation, reliability, and cleanliness of operation with respect to the fluid being pumped. Gear pumps and related pumps also are advantageous for pumping fluids while keeping the fluids isolated from the external environment. This latter benefit has been further enhanced with the advent of magnetically coupled pump-drive mechanisms that have eliminated leak-prone hydraulic seals that otherwise would be required around pump-drive shafts.

Gear pumps have been adapted for use in many applications, including applications requiring extremely accurate delivery of a fluid to a point of use. Consequently, these pumps are widely used in medical devices and scientific instrumentation. Developments in many other areas of technology have generated new venues for accurate pumps and related fluid-delivery systems. Such applications include, for example, delivery of liquids in any of various automotive applications.

Automotive applications are demanding from technical, reliability, and environmental viewpoints. Technical demands include spatial constraints, ease of assembly and repair, and efficacy. Reliability demands include requirements for high durability, vibration-resistance, leak-resistance, maintenance of hydraulic prime, and long service life. Environmental demands include internal and external corrosion resistance, and ability to operate over a wide temperature range.

A typical automotive temperature range includes temperatures substantially below the freezing temperature of water and other dilute aqueous liquids. These temperatures can be experienced, for example, whenever an automobile is left out in freezing winter climate. In contrast to many other substances, water and most aqueous solutions tend to expand as they undergo the phase change from liquid to ice. As is well known in household plumbing systems exposed to sub-freezing temperatures, the static pressures produced by freeze-expansion are sufficiently high to fracture pipe. Thus, these pressures can cause substantial damage to a pump that is coupled in a primed condition to a hydraulic circuit exposed to a sub-freezing temperature.

In view of the above, the simplest solution that might be proposed is simply to add anti-freeze to the liquid or to constitute the liquid with sufficient solute to depress its freezing point. Unfortunately, changing the liquid in these ways changes the composition and possibly other important properties of the liquid, which may render the liquid ineffective for its intended purpose. Hence, there is a need for pumps that can effectively withstand the internal pressure generated by a freezing condition without exhibiting damage that otherwise would be caused by freeze-expansion.

There is also a need for pumps that exhibit reduced pressure pulsatility of the output stream of liquid being pumped. Although many types of gear pumps, for example, deliver substantially continuous output streams, the output streams nevertheless tend to exhibit at least some pressure pulsatility that is synchronous with the rate at which increments of liquid between successive gear teeth are delivered downstream by the pump-head. Output-pressure pulsatility, a dynamic rather than static phenomenon, is exhibited by many types of pumps, including conventional gear pumps, piston pumps, and the like. Certain types of pumps, such as piston pumps, tend to exhibit a higher-amplitude output-pressure pulsatility than other types, such as gear pumps. Nevertheless, certain highly precise applications would be better served using pumps, otherwise highly effective for their assigned uses, that produce substantially less output pulsation than their conventional counterparts.

SUMMARY

The needs articulated above are met by, inter alia, pumps, pump-heads, and methods as disclosed herein. The subject pumps and pump-heads operate in a substantially primed condition. Since liquids are substantially non-compressible, conventional pumps operating in a primed condition are vulnerable to pressure damage if liquid in the pumps is allowed to freeze and thus undergo freeze-expansion (and if the liquid is one, such as water, that expands as it freezes). I.e., in a conventional primed pump, it may be very difficult or impossible for the liquid to find additional hydraulic space for expansion as the liquid freezes. Conventional primed pumps also tend to exhibit pressure fluctuations generated by the particular pumping action of the "pumping member" of the pump, such as contra-rotating gears, reciprocating piston, or the like. Pumps as disclosed herein automatically provide additional hydraulic space, as needed, to absorb these pressure increases, whether of relatively low amplitude accompanying the pumping action or of relatively high magnitude as generated during freezing. This provision of additional hydraulic space can occur repeatedly for an indefinite length of time, which is effective in reducing pressure fluctuations accompanying pumping action, and can be maintained indefinitely in a static manner, which is effective for reducing a pressure increase in the pump accompanying freezing of the liquid in the pump.

An embodiment of a pump comprises a pump housing defining a pump cavity, at least one inlet, and at least one outlet. The pump housing includes at least one interior non-wearing location that contacts liquid in the pump housing when the pump housing is primed with the liquid. The pump includes a movable pumping member situated in the pump cavity. The pumping member, when driven to move, urges flow of the liquid from the inlet through the pump cavity to the outlet. At least one pressure-absorbing member is located inside the pump housing at the non-wearing location and contacts the liquid. "In the pump housing" can be any location in the pump cavity, the inlet(s), and the outlet(s), including any additional internal cavity of the pump housing contacting the liquid and in fluid communication with the pump cavity, such as, but not limited to, a magnet-cup cavity. The pressure-absorbing member has a compliant property so as to exhibit a volumetric compression when subjected to a pressure increase in the liquid contacting the pressure-absorbing member. This volumetric compression is sufficient to alleviate at least a portion of the pressure increase. Alleviating the pressure increase can be sufficient to prevent freeze-expansion damage to the pump, and/or can be sufficient to reduce pressure fluctuations in the pumped liquid, such as at the outlet of the pump. Alleviation of pressure fluctuations is further facilitated by the pressure-absorbing member also exhibiting a volumetric expansion when subjected to a pressure decrease in the liquid contacting the pressure-absorbing member.

In certain embodiments of the pump, the movable pumping member comprises a rotatable pumping member, such as at least one gear. These gear-including embodiments typically have at least one "driving" gear and at least one "driven" gear that contra-rotate about their respective axes in the usual manner of gear pumps. In other embodiments the movable pumping member comprises at least one piston that typically undergoes a reciprocating motion.

The pressure-absorbing member(s) desirably are respective units of a closed-cell foam material. Example materials of this type include, but are not limited to, silicone closed-cell foams, fluorosilicone closed-cell foams, polyurethane closed-cell foams, any of various rubber-based closed-cell foams, and the like. Certain applications are favorably served by a pressure-absorbing member being a high-stiffness closed-cell foam material such as, but not limited to, aluminum closed-cell foam. The material for the pressure-absorbing member can be selected based on chemical inertness, flexibility, contractile stiffness, ease of manufacturability in the sizes and shapes needed, etc.

A pump as summarized above, aside from the "mover" used to actuate the pump, is usually termed a "pump-head." Pump-heads can be manufactured and distributed as units that can be coupled to various movers. Example movers are any of various types of motors that can be coupled directly or indirectly to the movable pumping member in the pump-head. Actuation of the mover causes corresponding motion of the movable pumping member in the pump cavity. An example mover includes a magnet coupled to the movable pumping member, and a magnet driver magnetically coupled to the magnet to move the magnet (e.g., rotate it about its axis) and thus move the pumping member in the pump cavity. Pumps including magnetic movers are generally termed "magnetically actuated" pumps. Such pumps are advantageous because they allow elimination of leak-prone dynamic seals such as shaft seals. Alternatively, the mover can include a mechanical, rather than magnetic, coupling to the movable pumping member such as, for example, a direct coupling to the armature of an electrical motor.

Any of various embodiments of the pump can further include at least one sensor in fluid communication with the liquid in the pump housing. Example sensors include, but are not limited to, pressure sensors, temperature sensors, flow sensors, chemical sensors, and the like. Desirably, at least one pressure-absorbing member is situated, in the pump housing, adjacent the sensor to protect the sensor from pressure extremes and/or to smooth pressure fluctuations in the vicinity of the sensor. More than one sensor can be used.

According to another aspect, gear pump-heads are provided. An embodiment of such a pump-head comprises a pump housing that defines a gear cavity, at least one inlet hydraulically coupled to the gear cavity, at least one outlet hydraulically coupled to the gear cavity, and at least one interior non-wearing location that contacts liquid in the pump housing. At least one driving gear and one driven gear are enmeshed with each other in the gear cavity. At least one pressure-absorbing member is located inside the pump housing at the non-wearing location and contacts the liquid. The pressure-absorbing member has a compliant property so as to exhibit a volumetric compression when subjected to a pressure increase in the liquid contacting the pressure-absorbing member. The volumetric compression is sufficient to alleviate at least a portion of the pressure increase.

The pump housing of the gear pump-head can further include a cup-housing. The cup-housing defines a cup cavity in hydraulic communication with the gear cavity. The cup cavity contains the liquid and a rotatable driven magnet that is coupled to the driving gear such that rotation of the magnet about its axis causes corresponding rotation of the driving gear and thus of the driven gear. A convenient location for a pressure-absorbing member is in the cup cavity. These embodiments can impart rotation to the magnet by magnetically coupling the magnet to a second magnet, called a "driving" magnet mounted on the armature of a motor. Alternatively, rotation of the magnet in the cup can be caused by placing a stator in coaxial surrounding relationship to, but outside of, the cup-housing. The stator is magnetically coupled to the magnet so as to cause, whenever the stator is electrically energized, rotation of the magnet. This latter embodiment eliminates the driving magnet.

As noted above, the gear pump-head can further comprise at least one sensor in fluid communication with the liquid in the pump housing. At least one pressure-absorbing member desirably is situated, in the pump housing, adjacent the sensor to protect the sensor from pressure extremes and/or to reduce pressure fluctuations in the vicinity of the sensor.

According to another aspect, hydraulic circuits are provided. An exemplary circuit comprises a pump, such as any of the embodiments summarized above, a liquid source hydraulically connected upstream of the pump to the pump inlet, and a liquid-discharge port hydraulically connected downstream of the pump to the pump outlet. The pump can be, by way of example, a gear pump or a piston pump. But it will be understood that these specific pumps are not intended to be limiting. Various other specific types of pumps can readily accommodate at least one pressure-absorbing member as discussed herein.

Also provided are methods, in the context of a method for pumping a liquid using a substantially primed pump, for preventing a fluid cavity of the pump from experiencing at least a threshold magnitude of pressure increase in the liquid in the fluid cavity. An embodiment of such a method comprises placing a pressure-absorbing member at a non-wearing location within the fluid cavity of the pump. The pressure-absorbing member is configured to undergo a volumetric contraction in the fluid cavity whenever the liquid in the fluid cavity experiences the pressure increase, wherein the volumetric contraction of the pressure-absorbing member is sufficient to reduce the pressure increase. The threshold magnitude can be, for example, a pressure that would be generated in the fluid cavity if the liquid in the fluid cavity became at least partially frozen. In such a case, the pressure-absorbing member desirably is configured to undergo a volumetric contraction sufficient to prevent damage to the pump that otherwise would occur from the at least partial freezing of the liquid in the fluid cavity. Alternatively or in addition, the threshold magnitude is a pressure generated in the fluid cavity as a result of a pressure fluctuation of the liquid in the fluid cavity accompanying operation of the pump.

Also provided are methods, in the context of a method for pumping a liquid using a substantially primed pump, for reducing a pressure fluctuation in liquid being urged to flow by the pump. An embodiment of such a method comprises placing a pressure-absorbing member at a non-wearing location within a fluid cavity of the pump. The pressure-absorbing member desirably is configured to undergo volumetric changes in the fluid cavity as the liquid in the fluid cavity is being pumped by the pump, wherein the volumetric changes are sufficient to reduce the pressure fluctuation.

The foregoing and other objects, features, and advantages of the invention will become more apparent from the following detailed description, which proceeds with reference to the accompanying figures.

DETAILED DESCRIPTION

This disclosure is set forth in the context of representative embodiments that are not intended to be limiting in any way.

As used herein, the singular forms "a," "an," and "the" include the plural forms unless the context clearly dictates otherwise. Additionally, the term "includes" means "comprises." Further, the term "coupled" encompasses mechanical as well as other practical ways of coupling or linking items together, and does not exclude the presence of intermediate elements between the coupled items.

The described things and methods described herein should not be construed as being limiting in any way. Instead, this disclosure is directed toward all novel and non-obvious features and aspects of the various disclosed embodiments, alone and in various combinations and sub-combinations with one another. The disclosed things and methods are not limited to any specific aspect or feature or combinations thereof, nor do the disclosed things and methods require that any one or more specific advantages be present or problems be solved.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed things and methods can be used in conjunction with other things and method. Additionally, the description sometimes uses terms like "produce" and "provide" to describe the disclosed methods. These terms are high-level abstractions of the actual operations that are performed. The actual operations that correspond to these terms will vary depending on the particular implementation and are readily discernible by one of ordinary skill in the art.

In the following description, certain terms may be used such as "up," "down,", "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

First Embodiment

Figure 1A:
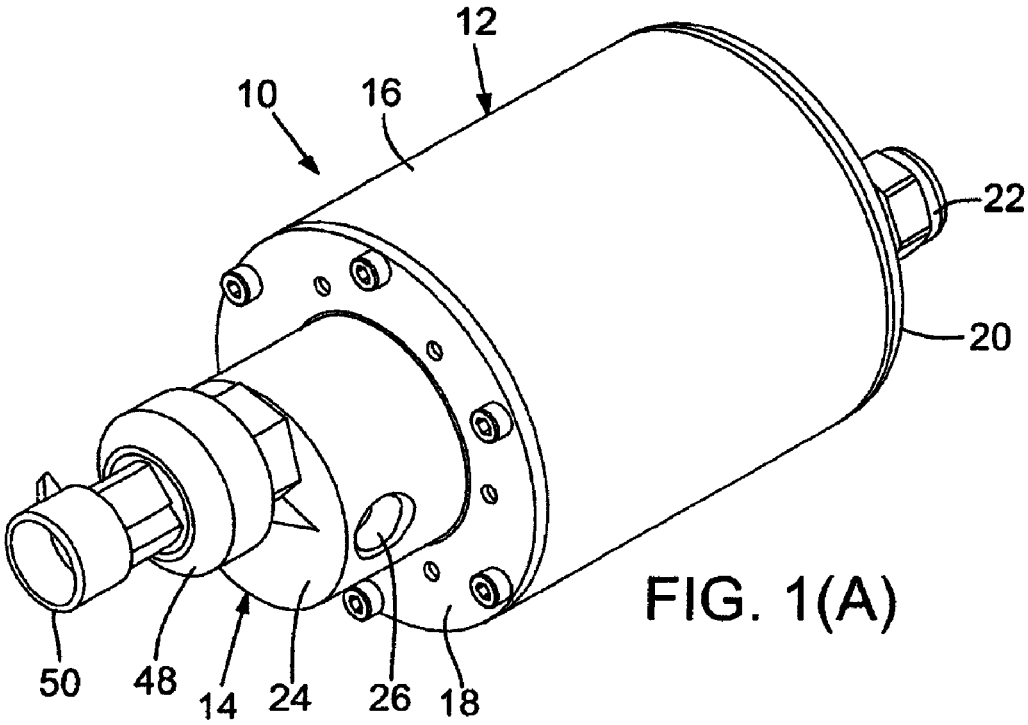
FIG. 1(A) is perspective view of a pump according to the first embodiment, including a magnetically driven gear pump-head with attached stator utilized as a mover for the pump.
Figure 1B:
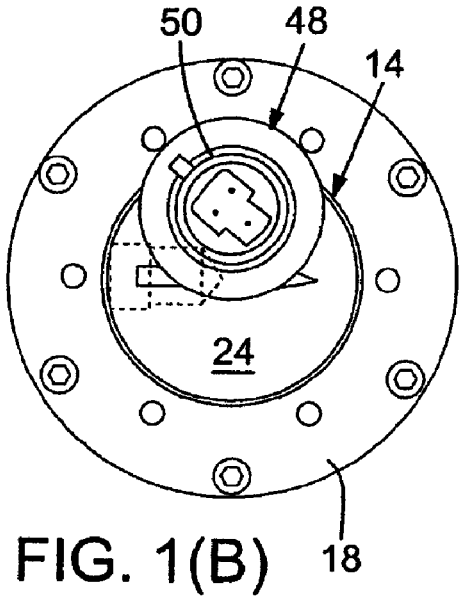
FIG. 1(B) is an orthogonal end-view of the pump of FIG. 1(A), showing the pump-head.
Figure 1C:
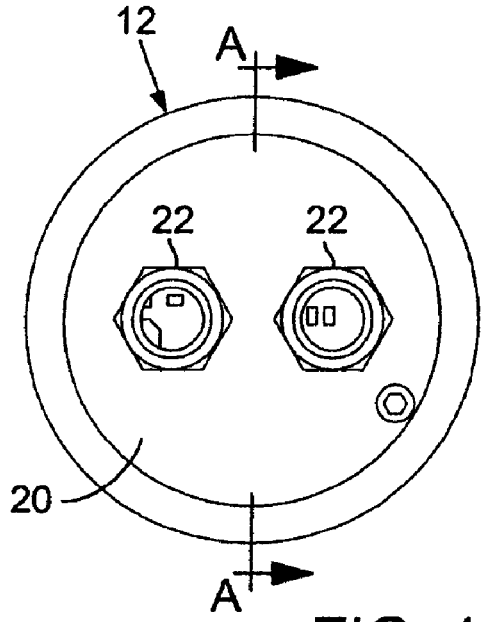
FIG. 1(C) is an orthogonal end-view of the opposite end of the pump of FIG. 1(A).
Figure 1D:
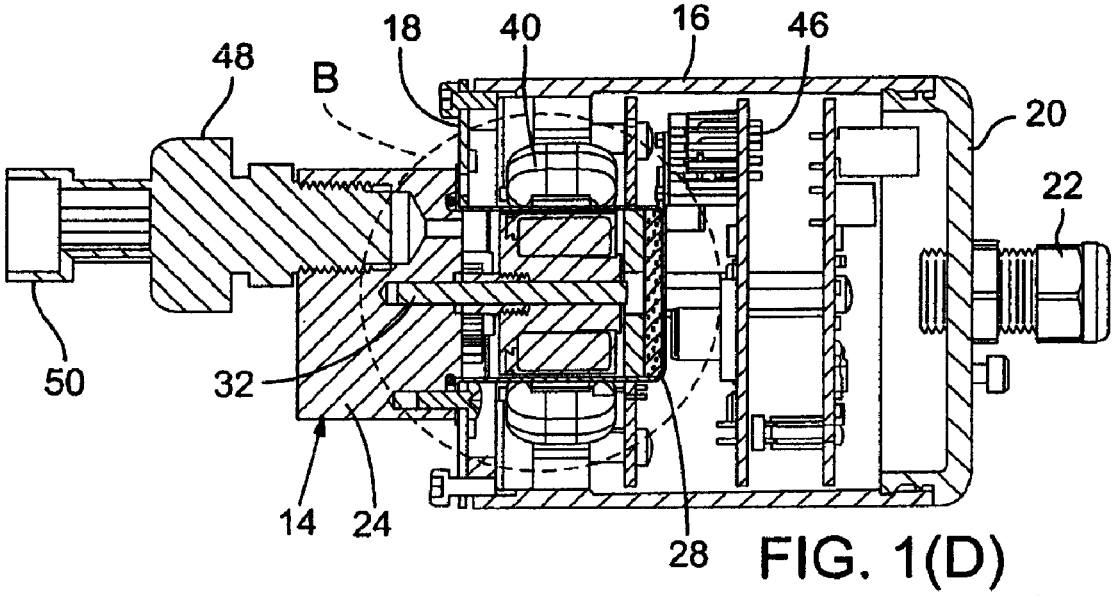
FIG. 1(D) is a medial sagittal section through the pump of FIG. 1(A).
Figure 1E:
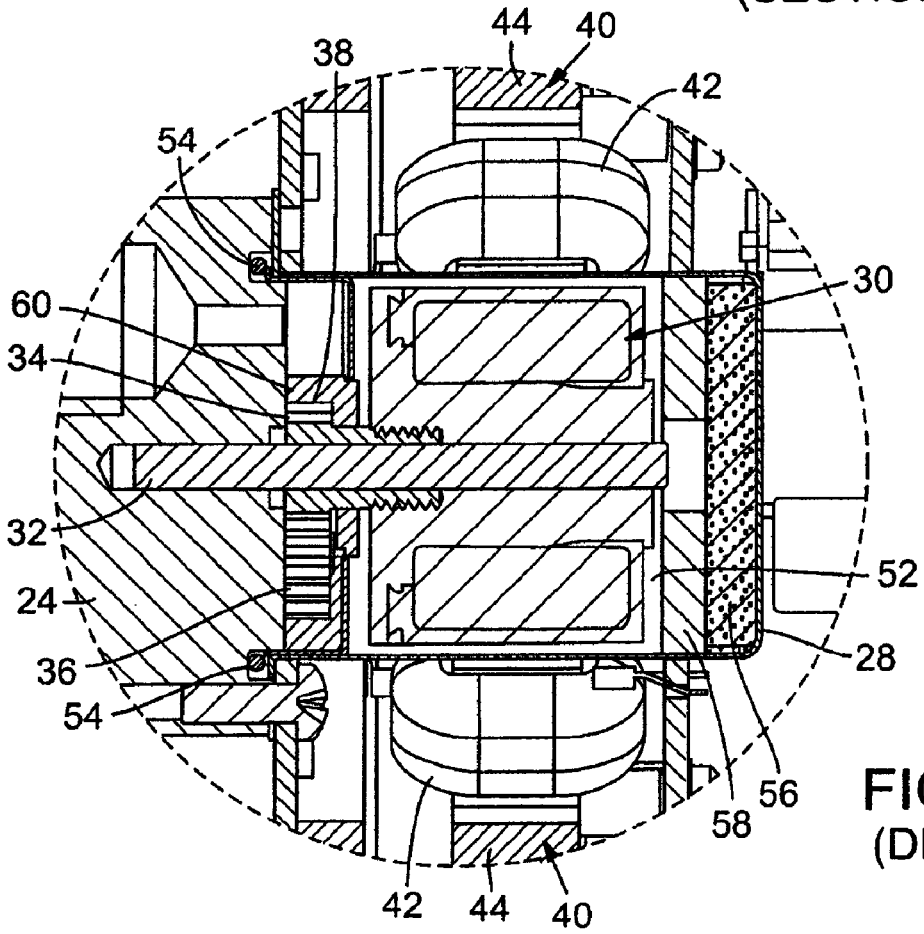
FIG. 1(E) is a detail of the area within the circle "B" in FIG. 1(D), showing a pressure-absorbing member located at the distal end of the magnet cup.

A first embodiment of a pump 10 is depicted in FIGS. 1(A)-1(E), which depicts a perspective view (FIG. 1(A)), orthogonal end views (FIGS. 1(B) and 1(C)), and sections (FIGS. 1(D) and 1(E)). The pump 10 is a magnetically driven type. It comprises an actuator portion 12 and a pump-head portion 14. The actuator portion 12 comprises an outer casing 16, a first end-plate 18, and a second end-plate 20, and contains a "mover" for the pump-head portion 14, as described below. The second end-plate 20 includes electrical connectors 22. The pump-head portion 14 includes a fitting block 24 that defines an inlet port and outlet port (only the outlet port 26 is visible). The pump-head portion 14 also includes a cup-housing 28 that contains a rotatable magnet 30 mounted to a shaft 32. The shaft 32 is mounted to a driving gear 34 that rotates and that interdigitated (meshed) with a driven gear 36. The gears 34, 36 are situated in a gear cavity 38 (a portion of the "pump cavity" that also includes the interior surfaces of the inlet and outlet ports). The gear cavity 38 and the interior of the cup-housing 28 ("cup cavity") are wetted by liquid being pumped by the pump 10. The magnet 30 has multiple magnetic poles that are magnetically coupled, in this embodiment, through the wall of the cup-housing 28, to a stator 40 contained within the outer casing 16.

It will be understood that "gear" as used herein encompasses rotary members configured as conventional pump gears as well as any of various other rotary members having lobes, teeth or the like that interdigitate with the same of a second such member to produce, when contra-rotated relative to each other, fluid flow.

The stator 40 comprises wire windings 42 associated with an iron core 44 that surrounds the cup-housing 28 in a coaxial manner. The windings 42 are selectively energized by electronics 46 also contained within the outer casing 16. Power is supplied to the electronics 46 via the connectors 22. Thus, energization of the stator 40 causes axial rotation of the magnet 30, which rotates the driving gear 34, which rotates the driven gear 36. This contra-rotation of the gears 34, 36 urges flow of liquid through the cavity 38. For improved operation with certain liquids, the cavity 38 optionally may include a suction shoe (not detailed).

The fitting block 24 defines passageways leading to and from the cavity 38 and connecting the cavity to the inlet and outlet ports 26. If desired or required, the fitting block 24 also includes a pressure transducer 48 (that can be hydraulically connected to the outlet 26, for example). The pressure transducer 48 includes an electrical connector 50 permitting electrical connection of the pressure transducer 48 in a manner that establishes feedback control of energization of the stator 40. The fitting block 24 is coupled to the end plate 18 and is sealed against the rim of the cup-housing 28 to establish, within the cup-housing 28, a cup cavity 52. The cup cavity 52 is sealed using a static seal 54 (e.g. an O-ring). The cup cavity 52 is in hydraulic communication with the gear cavity 38, and hence both are wetted by the pumped liquid, as noted above. Also, during normal operation, at least the cup cavity 52 and gear cavity 38 are substantially primed with the liquid being pumped.

Also contained within the pump cavity, more specifically within the cup cavity 52 of this embodiment, is a pressure-absorbing member 56. In this embodiment the pressure-absorbing member 56 is located adjacent the distal end of the magnet and secured by a retaining ring 58. In other embodiments the retaining ring 58 can be eliminated, or another securing means can be used, as appropriate. The retaining ring 58 keeps the member 56 in position to prevent the member from interfering with rotation of the magnet 30.

The pressure-absorbing member 56 can be made of any of various materials allowing the pressure-absorbing member 56 to compress or contract in response to an increase in pressure of the liquid inside the cup cavity 52 and/or inside the pump cavity 38. The pressure increase can be static, such as accompanying freezing of the liquid inside the pump cavity, or dynamic, such as a corresponding portion of a pressure fluctuation in the liquid as it is being pumped. For absorbing freeze-expansion pressure, the pressure-absorbing member 56 desirably has sufficient compressible volume such that, if the liquid inside the primed cavity freezes and expands, the resulting increase in pressure inside the cavity causes the pressure-absorbing member 56 to contract sufficiently to "absorb" the expansion and thus prevent a buildup of pressure inside the pump that would otherwise damage the pump. By way of example, water and dilute aqueous solutions exhibit a maximum expansion of approximately 11% by volume upon undergoing the phase transition from liquid to solid. By contracting in response to this volume increase, the pressure-absorbing member 56 prevents freeze damage to the pump such as fracture of the cup-housing 28, damage to the magnet 30, damage of the pressure transducer 48, and/or damage to other parts of the pump 10. If the pressure-absorbing member is intended only to attenuate pressure fluctuations, it can be smaller than a corresponding member intended to protect against freeze-expansion, depending upon the amplitude of the target pressure fluctuations.

The gear pump can be made of any of various materials that are inert to the particular liquid to be pumped. For example, and not intending to be limiting, PEEK can be used for the gears 34, 36, the cup-housing 28, and the retaining ring 58.

In addition to its pressure-absorption capability, the member 56 also desirably is chemically inert to the fluid being pumped and desirably maintains its pressure compliance and integrity over the full operating temperature range of the pump 10. Not intending to be limiting, an exemplary material for fabricating the member 56 is fluorinated silicone closed-cell foam, which is highly inert and maintains flexibility over a wide temperature range. As made of such material, the member 56 can be cut, punched, or molded, for example, into a size and shape suitable for placement in the pump. Other candidate materials are ordinary silicone closed-cell foam, polyurethane closed-cell foam, and any of various rubber closed-cell foams. The "closed cell" property is important because an open-cell configuration would absorb the liquid over time, which would compromise the pressure-absorption function.

It is not always necessary that the pressure-absorbing member 56 be rubbery in consistency. Stiffer configurations may be suitable for certain conditions or fluids. An exemplary stiffer material than the elastomeric closed-cell foams discussed above is aluminum closed-cell foam. Closed-cell materials essentially are assemblages of multiple gas bladders, and there are no particular limits on size and/or number of bladders. The bladders can be large or small, few or many, all substantially the same size or of variable size. Parameters such as size, thickness, stiffness, and composition of the pressure-absorbing member can be selected depending upon the size and type of pump-head, the composition of the liquid to be pumped by the pump-head, the forces expected to be experienced by the pressure-absorbing member, the volumetric expansion expected if the liquid in the pump-head freezes, the magnitude of pressure fluctuations to be damped, the particular environment of the pressure-absorbing member inside the pump-head, etc. Another advantage of the pressure-absorbing member is that it can respond very rapidly to pressure increases.

In addition to or aside from its role in absorbing the pressure associated with freeze-expansion, the member 56 also effectively absorbs pressure fluctuations imparted to the pumped liquid by rotation of the gears 34, 36. These pressure fluctuations are an inherent consequence of many types of pumps relying upon rotating or other moving pumping members to urge flow of liquid. The fluctuations are typically of a regular, periodic nature, having a period that is proportional to the periodicity of the motion of the gears or other movable pump members. Although the fluctuations are normally of relatively low magnitude, at least in gear pumps, the fluctuations can be significant in certain applications and/or with certain other types of pumps such as piston pumps. In gear pumps, the pressure fluctuations arise by the fact that the contra-rotating gears have teeth between which are spaces with defined volumes occupied by liquid being urged by the gears to flow. The member 56 absorbs the pressure fluctuations by momentarily contracting a small amount in response to the respective momentary "pulse" of pumped liquid exiting the space between gear teeth. These volumetric responses by the member 56 can be very rapid, sufficiently rapid to coincide with and to be substantially in phase with the corresponding pressure fluctuations. By automatically experiencing periodic contractions and expansions in response to (and in synchrony with) the pressure fluctuations, the pressure-absorbing member 56 effectively damps these pressure fluctuations. Thus, the pressure-absorbing member 56 can be employed advantageously in the pump housing even if the pump housing is not expected to be subjected to a freezing condition.

In an experiment investigating the degree to which a pressure-absorbing member can damp pressure fluctuations at the outlet of a gear pump, reductions in magnitude of at least 10% were observed with a pump including the member versus a pump lacking the member. It will be appreciated that, as the pumping volume changes relative to the contractile volume of the pressure-absorbing member, the contractile volume can be tailored for specific applications. The size of pressure-absorbing member 56 useful for damping pressure fluctuations may be smaller than a pressure-absorbing member 56 that must contract sufficiently to absorb a pressure associated with freezing liquid in the pump housing.

Figure 2:
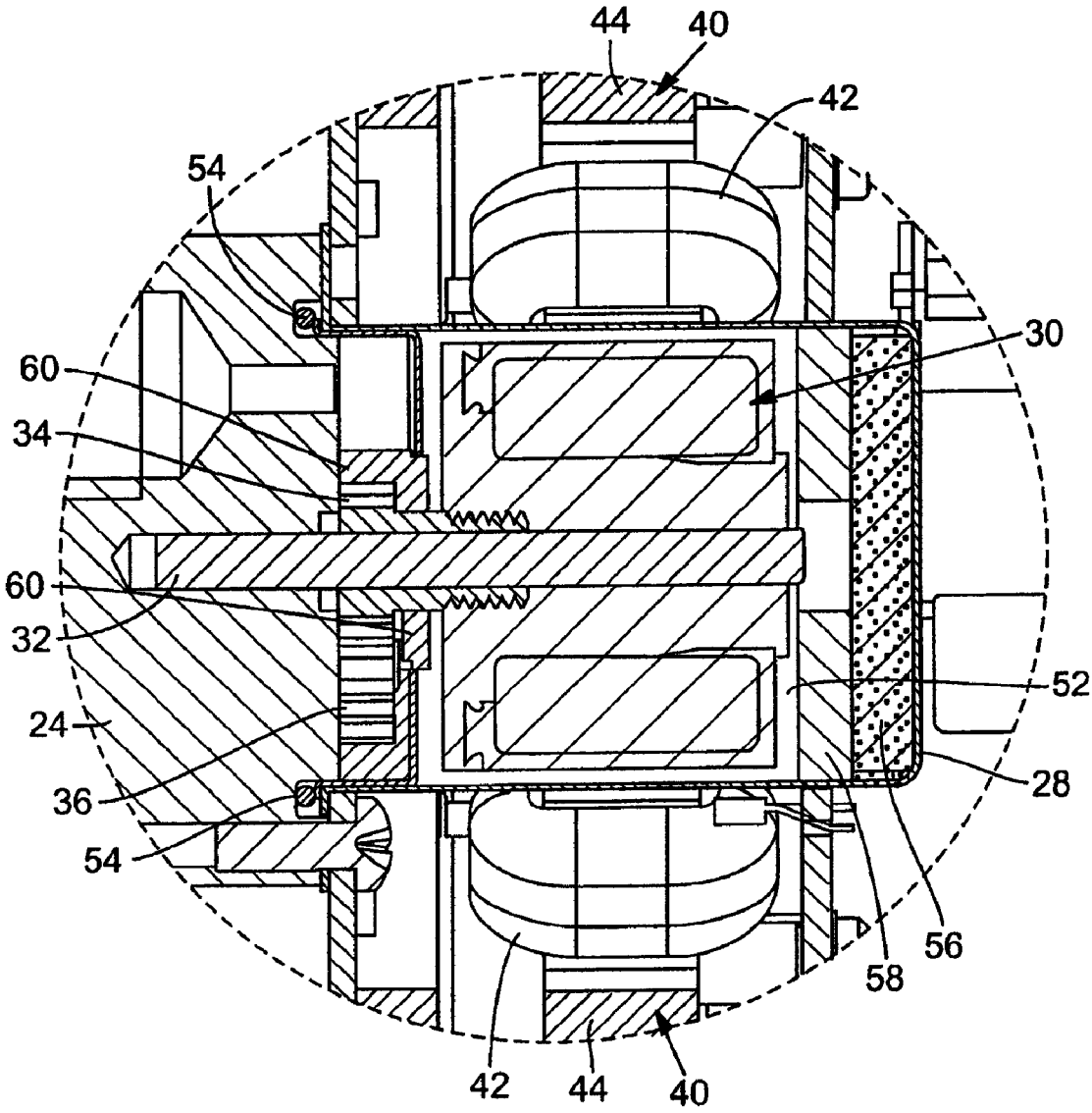
FIG. 2 is a further enlargement of detail shown in FIG. 1(E).

Magnified detail of the region shown in FIG. 1(E) is shown in FIG. 2, which shows, in addition to the components shown in FIG. 1(E), a suction shoe 60.

Second Embodiment

Figure 3:
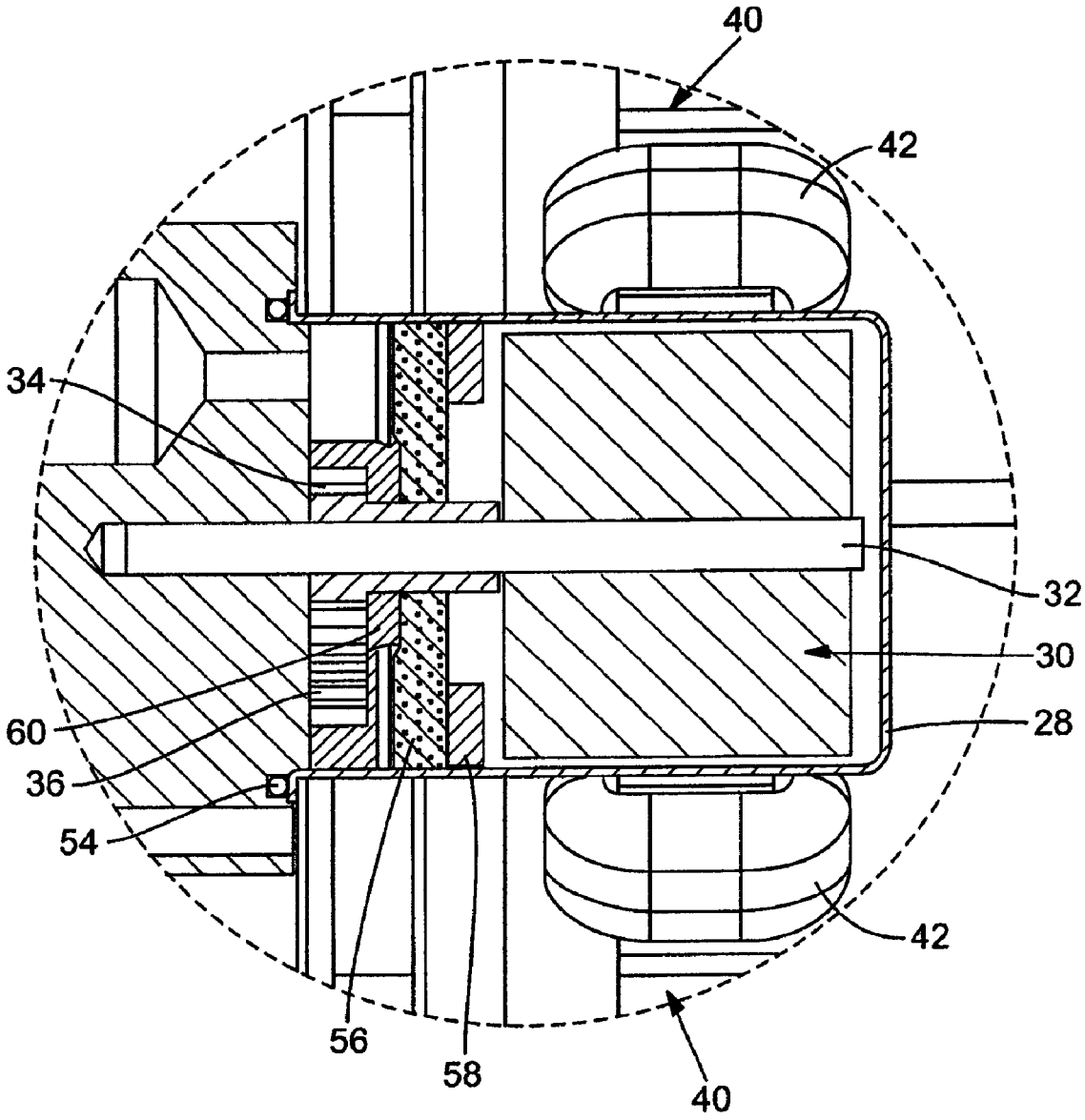
FIG. 3 shows enlarged details of a magnetically driven gear pump-head according to the second embodiment, in which the pressure-absorbing member is situated between the gears and the magnet.

The second embodiment is otherwise similar to the first embodiment, except that the pressure-absorbing member 56 has a different location inside the cup-housing than shown in FIGS. 1 and 2. Specifically, in the second embodiment, the pressure-absorbing member 56 is situated, in the cup-housing 28, between the gears 34 and the magnet 30, as shown in FIG. 3. I.e., the pressure-absorbing member 56 is located adjacent a proximal end of the magnet 30. The pressure-absorbing member 56 is held in place by a retaining ring 58. In this position, the pressure-absorbing member can serve to hold the suction shoe 60 in place, thereby eliminating the conventional need for a spring or the like for such a purpose.

In alternative configurations, the pressure-absorbing member is located at any of various other locations in the cup-housing. Example alternative locations include, but are not limited to, mounting on the magnet itself and mounting coaxially with the cup in a manner in which the inside walls of the cup-housing are lined with the pressure-absorbing member.

Third Embodiment

The first and second embodiments are magnetically driven pumps. But, principles disclosed herein are not limited to magnetically driven pumps. Magnetic drive is advantageous in general because it usually eliminates the need for a dynamic seal (e.g. a seal around a drive shaft coupled to the rotary member(s)). Pumps having dynamic seals (such as a shaft seal) typically do not have magnets or magnet cups, but they nevertheless are useful for many applications. Shaft seals are susceptible to damage caused by excess pressure inside the pump-head, such as pressure that would be generated by freeze-expansion of liquid inside the pump-head. Including at least one pressure-absorbing member inside such a pump-head would help protect the dynamic seal, and thus the pump itself, from freeze-expansion damage. Including at least one pressure-absorbing member in contact with the fluid path inside the pump-head also would provide damping of pressure fluctuations as described above. The manner in which the pump is actually driven does not significantly alter these needs or the remedies provided by including at least one pressure-absorbing member in the pump housing.

Figure 4A:
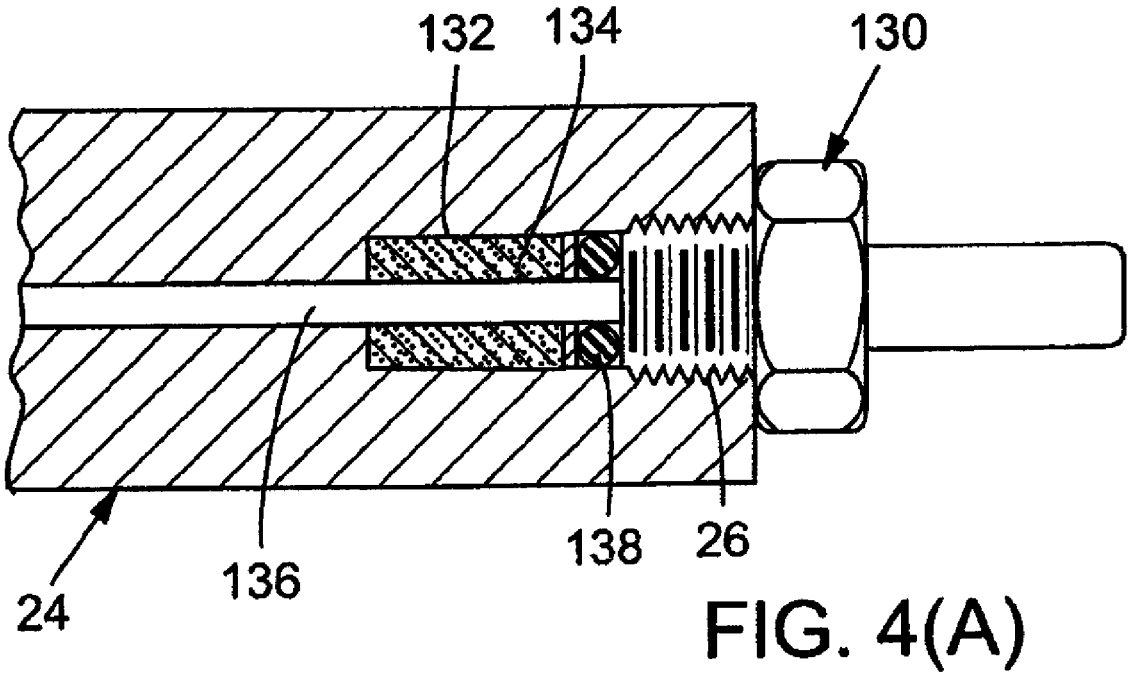
FIG. 4(A) shows a fitting block of a pump according to the third embodiment, in which a pressure-absorbing member is located in an outlet bore.

Hence, possible alternative locations of the pressure-absorbing member 56 are not limited to the magnet cup, regardless of whether the pump is magnetically driven. In general, possible locations in substantially any pump-head are any internal non-wearing surfaces inside the pump housing contacted by the pumped liquid. In some pump-heads, a suitable non-wearing surface may exist on the rotary member(s) of the pump. Also, alternatively to a single location, the pressure-absorbing member 56 can be located in multiple locations in the pump-head. In this embodiment, the pressure-absorbing member is located near the outlet 26. Reference is made to FIG. 4(A) that depicts a portion of the configuration of FIG. 1(A) in the vicinity of the fitting block 24 and outlet 26. In this embodiment, an outlet fitting 130 is threaded into the outlet 26. The outlet 26 includes a bore 132 into which a pressure-absorbing member 134 has been inserted. The pressure-absorbing member 134 defines a bore 136 to conduct pumped liquid into the fitting 130. The fitting 130 includes a static seal 138 (e.g., an O-ring). The pressure-absorbing member 134 provides at least the following: (a) protection of the pump-head itself from freeze-expansion damage, and (b) reducing pressure pulsations in the liquid being pumped by the pump-head.

Figure 4B:
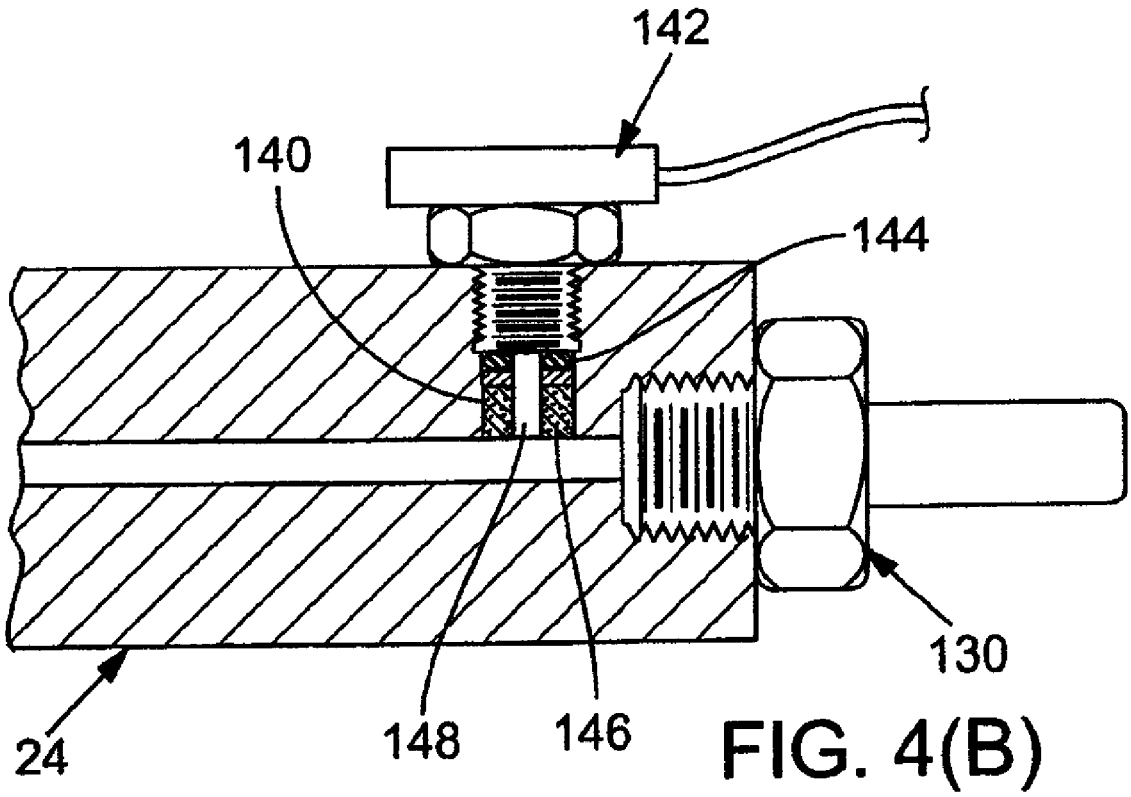
FIG. 4(B) shows a fitting block of an alternative configuration to that of FIG. 4(A), in which a pressure-absorbing member is located in a bore near the outlet port and leading to a sensor.

An alternative configuration is shown in FIG. 4(B), depicting the region in the vicinity of the fitting block 24 and outlet 26. In this configuration, the outlet 26 includes a branch bore 140 into which a transducer 142 (e.g., pressure transducer) is threaded. A static seal 144 (e.g., an O-ring) seals the connection. In the branch bore 144 is inserted a pressure-absorbing member 146. The pressure-absorbing member 146 defines a bore 148 allowing a fluid connection between the transducer 142 and the liquid in the outlet 26. The pressure-absorbing member 146 provides at least the following: (a) protection of the pump-head itself from freeze-expansion damage, (b) protection of the transducer 142 from freeze-expansion damage, and (c) reducing pressure pulsations in the liquid being pumped by the pump-head.

Yet another alternative configuration is a combination of the configurations of FIGS. 4(A) and 4(B), in which a respective pressure-absorbing member is situated in each of the depicted locations.

In yet another alternative configuration, the transducer 142 is a flow-meter rather than a pressure transducer, for example. A flow-meter usually is connected in series with the outlet 26, allowing a pressure-absorbing member to be situated in a manner similar to that shown in FIG. 4(A), wherein the flow-meter would be connected between the fitting block 24 and the fitting 130. The transducer 142 alternatively can be, for example, a temperature sensor, a conductivity sensor, or a chemical sensor (e.g., an ion-specific electrode or pH probe)

In yet other alternative configurations, respective pressure-absorbing members are inserted in any of various bores inside the pump-head, such as other fitting bores or connecting bores. These other bores, similar to the outlet 26, are non-wearing locations in the pump-head and hence are suitable locations for pressure-absorbing members. The particular location selected will depend, at least in part, on the size and layout of the pump-head, the accessibility of the location from a mechanical, machining, or molding point of view, and the particular pressure-absorbing specifications being addressed.

Fourth Embodiment

The range of candidate pump-heads is not limited to gear pumps. An exemplary alternative type of pump-head, without intending to be limiting, is a valveless piston pump. A valveless piston pump is disclosed in, for example, U.S. Patent Publication No. 2007-0237658, incorporated herein by reference. See particularly FIG. 11 of this reference and accompanying discussion on pages 9-14 thereof.

Figure 5:
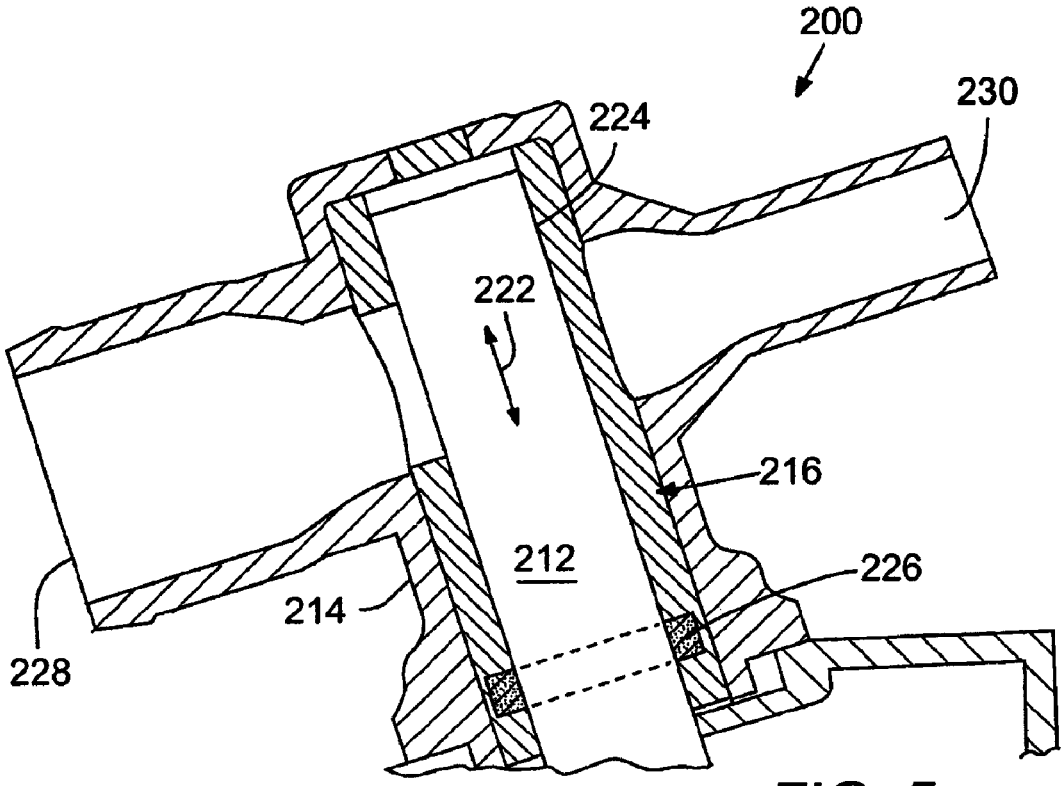
FIG. 5 is a section through a portion of the head of a piston pump, in which a pressure-absorbing member is located in the piston bore of the housing, according to the fourth embodiment.

Reference is now made to FIG. 5, depicting a portion of the piston pump-head 200, including the piston 212, the housing 214, the liner 216, the inlet port 228, the outlet port 230. The piston 212 moves in a reciprocating manner (arrows 222) in a bore 224 defined in the housing 214. Inserted into the bore is a pressure-absorbing member 226 that is in contact with the liquid in the bore (and pumped by the piston 212). The pressure-absorbing member 226 serves to damp pressure fluctuations produced in liquid being pumped by the piston pump. The pressure-absorbing member 226 also protects the pump-head from excessive pressure that otherwise would be produced inside the pump-head (e.g. in the bore 224) in a freezing situation.

Fifth Embodiment

Figure 6:
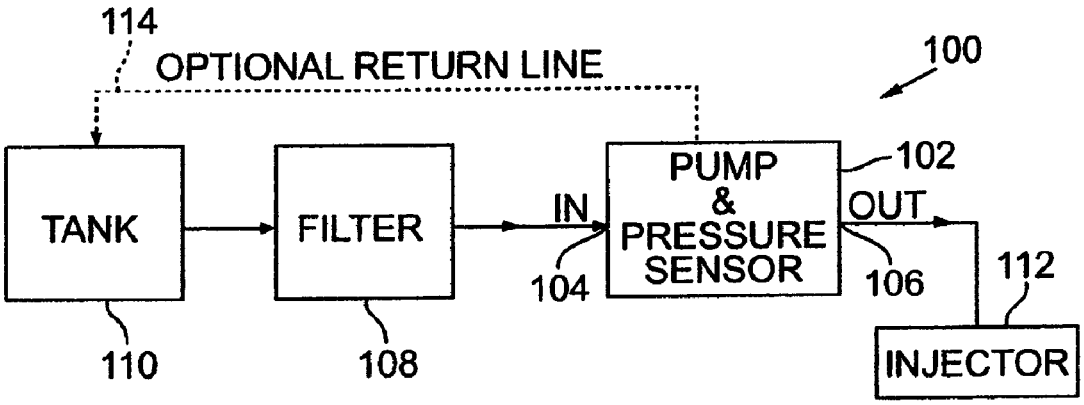
FIG. 6 is a schematic diagram of an exemplary hydraulic circuit including a pump-head, according to the fifth embodiment.

This embodiment is directed to a hydraulic circuit comprising a pump such as that described above. The circuit 100 is shown in FIG. 6, which includes a pump and pressure sensor 102 having an inlet 104 and an outlet 106. The pump and pressure sensor 102 can be as denoted by the device 10 described above in the first embodiment, or any other embodiment. The inlet 104 is situated downstream of a filter 108, which is situated downstream of a tank 110 serving as a reservoir for liquid to be pumped by the pump 102. The outlet 106 is hydraulically connected to a downstream injector 112 or other component from which pumped liquid is discharged from the circuit. If desired, the circuit 110 can include a return line 114 for returning liquid to the tank 100 that is not actually discharged from the injector 112.

The circuit 100 in FIG. 6 represents a circuit as used in an automotive application, in which at least the pump and pressure sensor 102 is located in an environment including freezing episodes. Since the pump 102 includes the pressure-absorbing member 56 as described above, freeze-expansion of liquid inside the pump 102 is absorbed by the member and thus prevented from producing pump-damaging pressure.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

What is claimed is:

1. A pump for pumping an aqueous liquid, comprising:

a pump housing defining a pump cavity, at least one inlet, at least one outlet, and a magnet cup, the pump housing contacting aqueous liquid in the pump housing whenever the pump housing is substantially primed with the liquid;

a movable pumping member situated in the pump cavity, the pumping member, when driven to move, urging flow of the aqueous liquid from the inlet through the pump cavity and magnet cup to the outlet;

a permanent magnet situated in the magnet cup, the magnet being rotatable in the magnet cup and being coupled to the movable pumping member in the pump housing;

a magnet driver located outside the magnet cup, the magnet driver being magnetically coupled through the magnet cup to the magnet to rotate the magnet in the magnet cup and thus move the pumping member in the pump cavity; and at least one pressure-absorbing member located inside the magnet cup, the pressure-absorbing member contacting the aqueous liquid and having a high-pressure compliant property so as to exhibit a volumetric compression when subjected to a pressure increase having a relatively high magnitude resulting from freeze-expansion of the aqueous liquid in the pump housing while not exhibiting volumetric compression when subjected to pressure increases having magnitude less than the relatively high magnitude, the volumetric compression occurring during freeze-expansion being sufficient to alleviate the relatively high-magnitude pressure increase and prevent freeze-damage to the pump housing.

2. The pump of claim 1, wherein the pressure-absorbing member further exhibits a volumetric expansion when subjected to a pressure decrease, in the liquid contacting the pressure-absorbing member, accompanying melting of the aqueous liquid in the pump housing.

3. The pump of claim 1, wherein the movable pumping member comprises a rotatable pumping member.

4. The pump of claim 3, wherein the rotatable pumping member comprises at least one gear.

5. The pump of claim 1, wherein the movable pumping member comprises at least one piston.

6. The pump of claim 1, wherein the at least one pressure-absorbing member comprises a unit of a closed-cell foam material.

7. The pump of claim 1, further comprising at least one interior non-wearing location in the magnet cup, wherein the pressure-absorbing member is located at the non-wearing location.

8. The pump of claim 1, further comprising at least one sensor in fluid communication with the liquid in the pump housing, wherein the at least one pressure-absorbing member is situated, in the pump housing, adjacent the sensor and in fluid communication with the liquid in the pump housing.

9. A gear pump-head, comprising:

a pump housing defining a gear cavity, at least one inlet hydraulically coupled to the gear cavity, at least one outlet hydraulically coupled to the gear cavity, and a cup-housing in hydraulic communication with the gear cavity, the pump housing being substantially primed with an aqueous liquid, and the cup-housing including at least one interior non-wearing location that contacts the aqueous liquid in the pump housing;

at least a driving gear and a driven gear enmeshed with each other in the gear cavity;

a permanent magnet situated in the cup-housing and being coupled to the driving gear in the gear cavity;

a magnet driver located outside the cup-housing and being magnetically coupled through the cup-housing to the magnet to rotate the magnet in the cup-housing and thus rotate the gears in the gear cavity; and a first pressure-absorbing member located inside the cup-housing at the non-wearing location and contacting the aqueous liquid, the first pressure-absorbing member having a high-pressure compliant property so as to exhibit a volumetric compression when subjected to a relatively high pressure accompanying freeze-expansion of the aqueous liquid contacting the pressure-absorbing member while not exhibiting volumetric compression when subjected to a pressure increase less than the relatively high pressure, the volumetric compression being sufficient to offset at least a portion of the freeze-expansion sufficient to prevent the freeze-expansion from damaging the pump housing.

10. The gear pump-head of claim 9, further comprising:

at least one sensor in fluid communication with the aqueous liquid in the pump housing; and a second pressure-absorbing member situated, in the pump housing, adjacent the sensor.

11. The gear pump-head of claim 9, wherein the first pressure-absorbing member is a unit of a closed-cell foam material.

12. A hydraulic circuit, comprising:

a pump;

a source of aqueous liquid hydraulically connected upstream of the pump; and a liquid-discharge port hydraulically connected downstream of the pump;

the pump comprising (a) a pump housing defining a pump cavity, at least one inlet, at least one outlet, and a magnet cup, the pump housing contacting aqueous liquid in the pump housing whenever the pump housing is substantially primed with the liquid; (b) a movable pumping member situated in the pump cavity, the pumping member, when driven to move, urging flow of the aqueous liquid from the inlet through the pump cavity and magnet cup to the outlet; (c) a permanent magnet situated in the magnet cup, the magnet being rotatable in the magnet cup and being coupled to the movable pumping member in the pump housing; (d) a magnet driver located outside the magnet cup, the magnet driver being magnetically coupled through the magnet cup to the magnet to rotate the magnet in the magnet cup and thus move the pumping member in the pump cavity; and (e) at least one pressure-absorbing member located inside the magnet cup, the pressure-absorbing member contacting the aqueous liquid and having a high-pressure compliant property so as to exhibit a volumetric compression when subjected to a pressure increase having a relatively high magnitude resulting from freeze-expansion of the aqueous liquid in the pump housing while not exhibiting volumetric compression when subjected to pressure increases having magnitude less than the relatively high magnitude, the volumetric compression occurring during freeze-expansion being sufficient to alleviate the relatively high-magnitude pressure increase and prevent freeze-damage to the pump housing.

13. The hydraulic circuit of claim 12, wherein the pump is a gear pump.

14. The hydraulic circuit of claim 12, wherein the pump is a piston pump.

15. The hydraulic circuit of claim 12, further comprising at least one sensor coupled to the pump housing and sufficiently near the pressure-absorbing member to experience hydraulic pressure experienced by the pressure-absorbing member.

16. A magnetically driven pump-head, comprising:

permanent-magnet means;

pump-member means;

housing means defining pump-cavity means, for enclosing said pump-member means, and magnet-enclosure means for enclosing said permanent-magnet means, said housing means including inlet means and outlet means, the inlet means being for introducing an aqueous liquid to the pump cavity;

said pump-member means being movable in and relative to said pump-cavity means for urging flow of the aqueous liquid, introduced by the inlet means, through said pump-cavity means substantially primed with the aqueous liquid, the outlet means being for conducting aqueous liquid, urged by motion of the pump-member means, from said pump-cavity means;

said permanent-magnet means being rotatable, when urged by a corresponding moving magnetic field produced outside said housing means, in said magnet-enclosure means and being coupled to said pump-member means to cause said pump-member means to cause said pump-member means to urge flow of the aqueous liquid through said housing means from said inlet means to said outlet means; and pressure-absorbing means, located at a non-wearing surface in said magnet-enclosure means so as to be contacted by the aqueous liquid, for attenuating a relatively high-magnitude pressure change of the aqueous liquid in said housing means accompanying freeze of the aqueous liquid in said housing means while not attenuating pressure changes of relatively low magnitude compared to the relatively high magnitude.

17. The pump-head of claim 16, wherein said pressure-absorbing means comprises compliant member means configured at least to compress upon experiencing a pressure increase, without experiencing significant saturation by the liquid.

18. The pump-head of claim 17, wherein said compliant member means is further configured to expand upon experiencing a pressure decrease, without experiencing significant saturation by the liquid.

19. The pump-head of claim 16, wherein said pump-member means comprises a driving gear and a driven gear meshed with the driving gear.

20. The pump-head of claim 16, further comprising driving means for imparting motion of the pump-member means in the pump cavity means.

21. The pump-head of claim 20, further comprising external stator means for producing the moving magnetic field.

* * * * *